US009418579B2

(12) United States Patent
Liu et al.

(10) Patent No.: US 9,418,579 B2
(45) Date of Patent: Aug. 16, 2016

(54) ELECTRONIC BILLBOARD

(71) Applicants: HONG FU JIN PRECISION INDUSTRY (ShenZhen) CO., LTD., Shenzhen (CN); HON HAI PRECISION INDUSTRY CO., LTD., New Taipei (TW)

(72) Inventors: Chun Liu, Shenzhen (CN); Chih-Kang Cho, New Taipei (TW); Quan Liao, Shenzhen (CN); Zhan-Ao Yu, Shenzhen (CN); Te-Hsu Wang, New Taipei (TW); Mei-Hua Liu, Shenzhen (CN)

(73) Assignees: HONG FU JIN PRECISION INDUSTRY (ShenZhen) CO., LTD., Shenzhen (CN); HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/546,220

(22) Filed: Nov. 18, 2014

(65) Prior Publication Data

US 2015/0138118 A1 May 21, 2015

(30) Foreign Application Priority Data

Nov. 19, 2013 (CN) ..... 2013 1 0580147

(51) Int. Cl.
*G09F 27/00* (2006.01)
*G09F 9/30* (2006.01)

(52) U.S. Cl.
CPC . *G09F 27/00* (2013.01); *G09F 9/30* (2013.01)

(58) Field of Classification Search
CPC ..... G09F 27/00
USPC ..... 361/679.01
See application file for complete search history.

(56) References Cited

U.S. PATENT DOCUMENTS

| | | | | |
|---|---|---|---|---|
| 2003/0063432 | A1* | 4/2003 | Farrow | G06F 1/1601 361/679.02 |
| 2004/0232298 | A1* | 11/2004 | Bremmon | F16M 11/10 248/281.11 |
| 2009/0057502 | A1* | 3/2009 | Takamatsu | F16M 11/00 248/158 |
| 2010/0321342 | A1* | 12/2010 | Lee | G06F 3/0428 345/175 |
| 2011/0110025 | A1* | 5/2011 | Yi | G06F 1/1601 361/679.6 |

FOREIGN PATENT DOCUMENTS

| | | | |
|---|---|---|---|
| TW | 201331911 | A | 8/2013 |
| WO | 2013/012152 | A1 | 1/2013 |

* cited by examiner

*Primary Examiner* — Liliana Cerullo
(74) *Attorney, Agent, or Firm* — ScienBiziP, P.C.

(57) ABSTRACT

An electronic billboard includes a base, bracket, a display and a touch device. The bracket is removable and mounted to the base. The display is removable and mounted to the bracket. The display includes a slot and a receiving portion configured to receive a host. The touch device is received in the slot.

17 Claims, 6 Drawing Sheets

ELECTRONIC BILLBOARD

CROSS-REFERENCE TO RELATED APPLICATIONS

This application claims priority to Chinese Patent Application No. 201310580147.8 filed on Nov. 19, 2013, the contents of which are hereby incorporated by reference.

FIELD

The subject matter herein generally relates to a display device, and more particularly to an electronic billboard.

BACKGROUND

An electronic display is widely used to make an electronic billboard instead of an advertising poster. The electronic billboard can display different advertisements and hardware or equipment does not need to be replaced. The electronic billboard can be displayed in public places such as railway stations, bus stations and so on.

BRIEF DESCRIPTION OF THE DRAWINGS

Implementations of the present technology will now be described, by way of example only, with reference to the attached figures.

DETAILED DESCRIPTION

Figure 1:
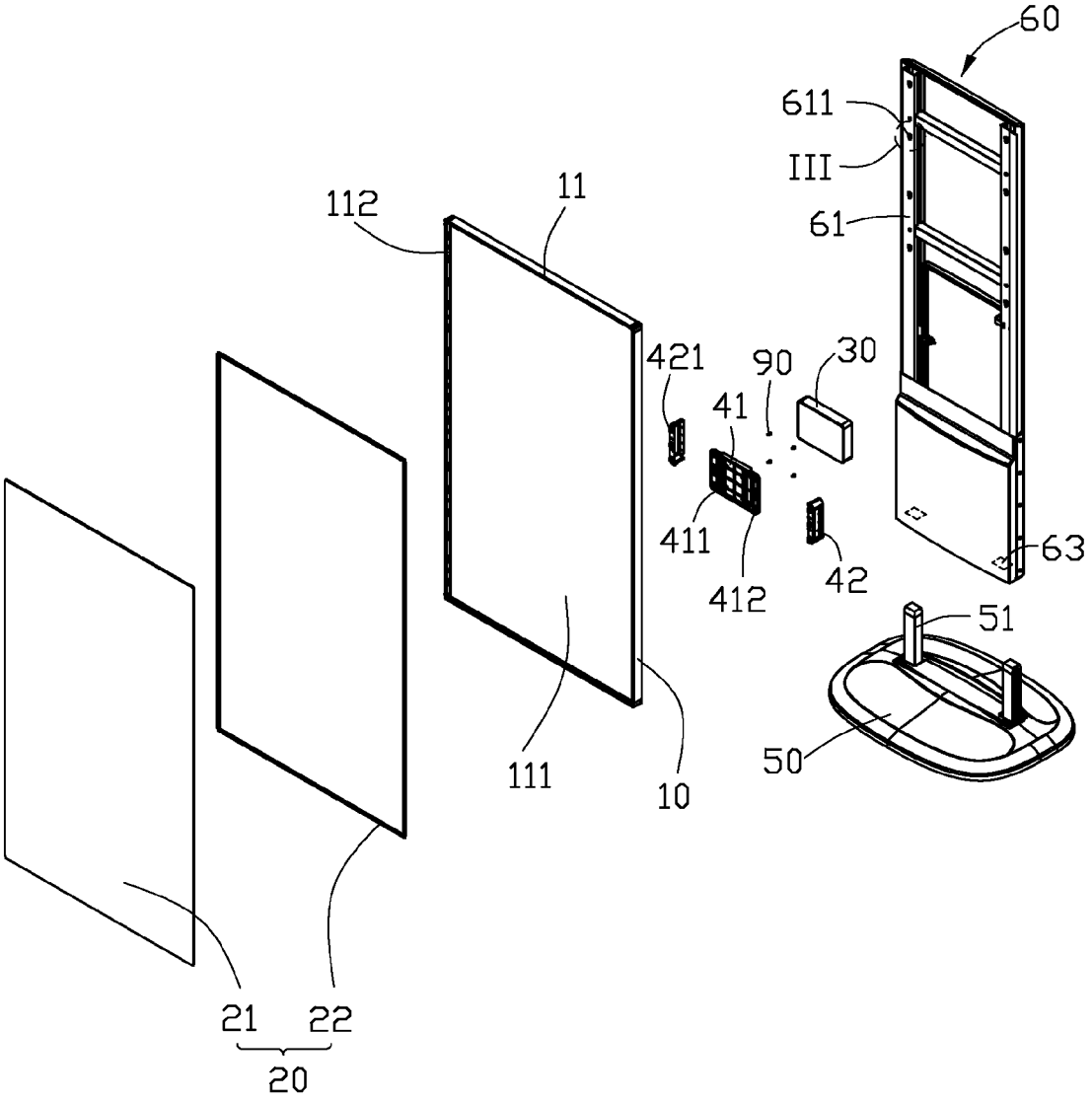
FIG. 1 is an exploded, isometric view of an electronic billboard in accordance with an embodiment.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "comprising," when utilized, means "including, but not necessarily limited to"; it specifically indicates open-ended inclusion or membership in the so-described combination, group, series and the like.

Figure 2:
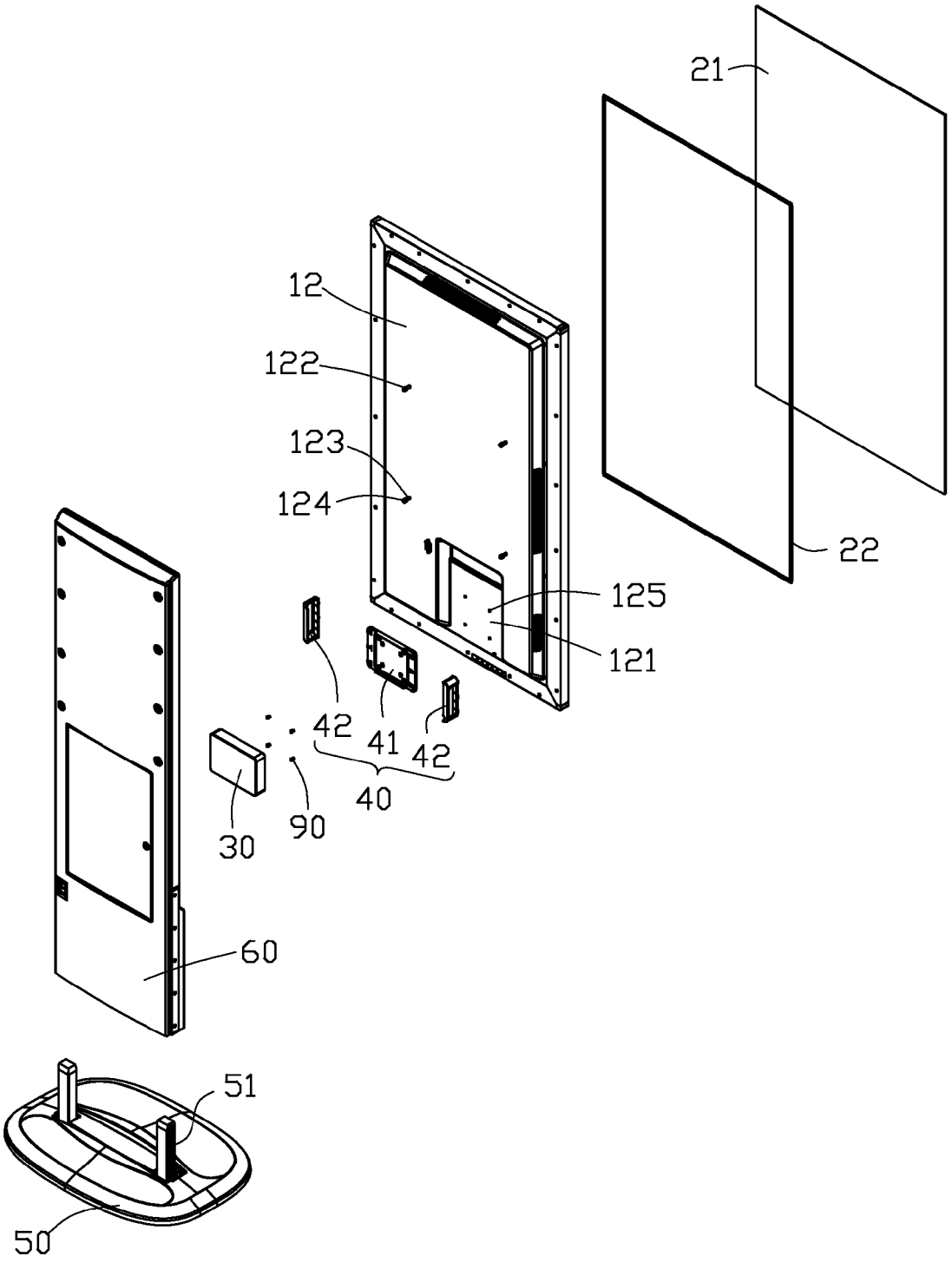
FIG. 2 is another exploded, isometric view of the electronic billboard of FIG. 1.

FIG. 1 and FIG. 2 illustrate an electronic billboard including a display 10, a touch device 20, a host 30, a base 50, and a bracket 60.

The display 10 includes a front wall 11, a screen 111, and a rear wall 12. A slot 112 configured to receive the touch device 20 is defined between the front wall 11 and a front side of the screen 111. A receiving portion 121 is defined at bottom of the rear wall 12. In at least one embodiment, the receiving portion 121 is a slot extending from the rear wall 12 to the front wall 11. A plurality of mounting holes 125 are defined in the receiving portion 121. Four sliding rods 122 are mounted to the rear wall 12 and located at four corners of a square area. In at least one embodiment, the sliding rods 122 are above the receiving portion 121 in a vertical direction. Each sliding rod 122 includes a shaft 123 and head 124. The shaft 123 is mounted on the rear wall 12, and the head 124 is connected to the shaft 123. A diameter of the head 124 is larger than a diameter of the shaft 123.

The touch device 20 includes a transparent touch sensing layer 21 and a frame 22 configured to surround the touch sensing layer 21. The touch sensing layer 21 can function with any operations. The frame 22 is made of flexible materials and can be elastically deformed. The electronic billboard further includes a mounting apparatus 40 to mount the host 30 in the receiving portion 121 of the display 10. The mounting apparatus 40 can include a mounting plate 41 and two sidewalls 42. A plurality of through holes 411 are defined in the mounting plate 41. A plurality of latching slots 412 are defined at two opposite sides of the mounting plate 41. Two sidewalls 42 are configured to set at two opposite sides of the host 40. Each sidewall 42 includes a plurality of hooks 421.

The base 50 includes two mounting posts 51.

The bracket 60 includes two supporting posts 61. A plurality of latching holes 611 are defined in the supporting posts 61. Two securing holes 63 corresponding to the mounting posts 51 are separately defined at a bottom of the bracket 30.

Figure 3:
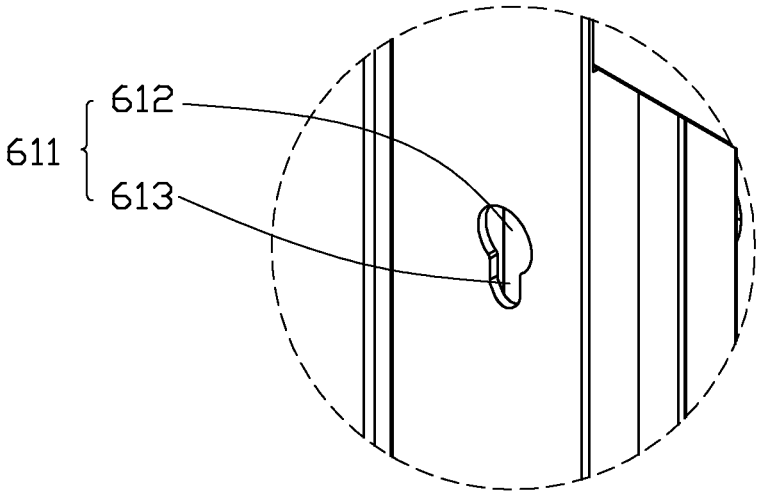
FIG. 3 is an enlarged view of a circled portion III of FIG. 1.

FIG. 3 illustrates each latching hole 611 includes a larger inserting portion 612 and a smaller mounting portion 613 connected to the inserting portion 612. A diameter of the inserting portion 612 is larger than that of the head 124. A diameter of the mounting portion 613 is larger than that of the shaft 123 and smaller than that of the head 124. The inserting portion 612 is above the mounting portion 613 in the vertical direction. In at least one embodiment, each latching hole 611 is gourd-shaped.

Figure 4:
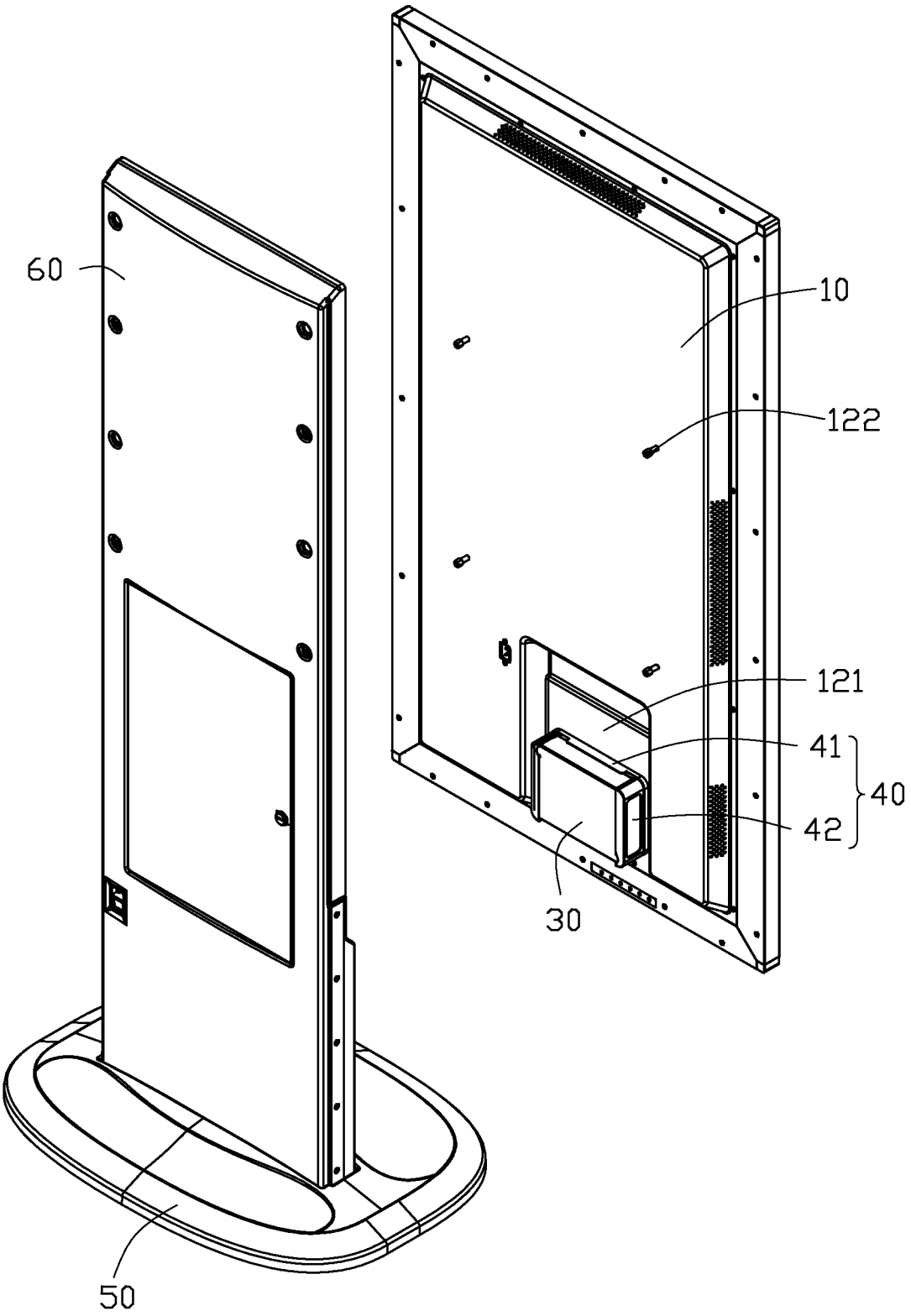
FIG. 4 is a partially exploded, isometric view of the electronic billboard.

FIG. 4 illustrates a partial assembly of the electronic billboard. The mounting posts 51 of the base 50 are engaged in the securing holes 63 of the base 60. The host 30 can be assembled to the display 10 to increase an expansion function of the electronic billboard. Two sidewalls 42 can be coupled to the host 30 and located at two opposite sides of the host 30. The hooks 431 of the sidewalls 42 are engaged in the corresponding latching slots 412 of the mounting plate 41. The through holes 411 of the mounting plate 41 are aligned with the mounting holes 125 of the display 10. A plurality of fasteners 90 are engaged in the though holes 411 and the mounting holes 125 to secure the host 30 in the receiving portion 121 of the display 10. The host 30 is electrically connected to the display 10. Users can control the host 30 to change contents on the display 10.

The touch device 20 can be assembled to the display 10. In that case, user can input operation commands for the touch device 20. The touch sensing layer 21 is surrounded by the frame 21. The frame 22 is inserted into the slot 112. The touch device 20 is located at the front side of the display 10. The transparent touch sensing layer 21 covers the screen 111. Users can input commands by pressing the touch sensing layer 21.

Figure 5:
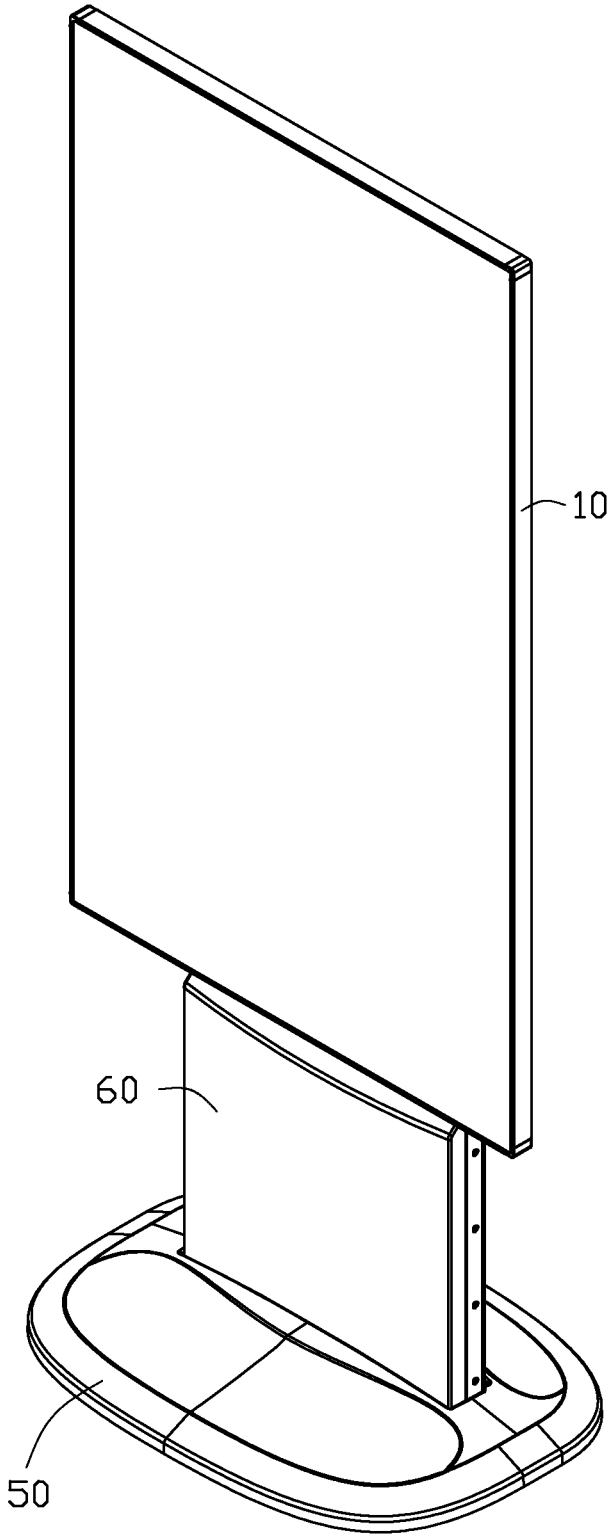
FIG. 5 is an assembled, isometric view of the electronic billboard of FIG. 1, wherein a display is located in a vertical direction.
Figure 6:
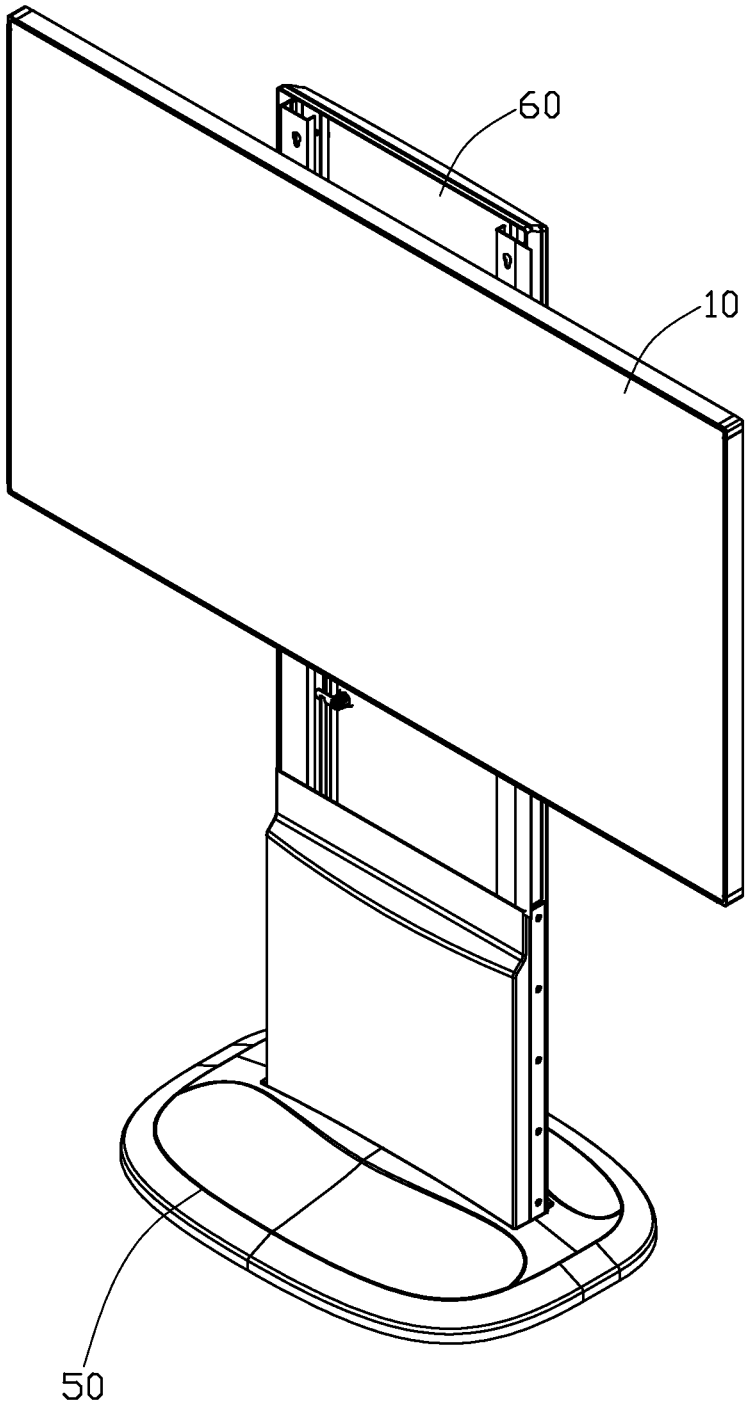
FIG. 6 is an assembled, isometric view of the electronic billboard of FIG. 1, wherein the display is located in a horizontal direction.

FIG. 5 and FIG. 6 illustrate the electronic billboard assembled. The heads 124 of four sliding rods 122 extend through corresponding inserting portions 612 of the latching holes 611. Each shaft 123 is received in the inserting portion 612, sliding into the mounting portion 613 from the inserting portion 612 by moving the display 10, and the head 124 abuts against the supporting post 61 around the mounting portion 613.

The display 10 can be mounted to the bracket 60 in the vertical direction or in a horizontal direction because the four sliding rods 122 are located at four corners of the square area.

The embodiments shown and described above are only examples. Many details are often found in the art such as the other features of an electronic billboard. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, especially in matters of shape, size and arrangement of the parts within the principles of the present disclosure up to, and including the full extent established by the broad general meaning of the terms used in the claims. It will therefore be appreciated that the embodiments described above may be modified within the scope of the claims.

What is claimed is:

1. An electronic billboard comprising:

a base;

a bracket removable mounted to the base;

a display removable mounted to the bracket, the display comprising a slot and a receiving portion being configured to receive a host computing device electrically coupled to the display to change contents on the display; and a touch device received in the slot, wherein the touch device comprises a frame surrounding the touch sensing layer, the frame is elastic deformation to insert into the slot.

2. The electronic billboard of claim 1, wherein the display comprises a screen, a front wall, and a rear wall, the slot is defined between the front wall and a front side of the screen, the receiving portion is located in the rear wall.

3. The electronic billboard of claim 2, wherein the receiving portion is a slot extending to the front wall from the rear wall.

4. The electronic billboard of claim 2, wherein a plurality of sliding rods extend from the rear wall of the display, the bracket defines a plurality of latching holes, the plurality of sliding rods are slidably mounted in the plurality of latching holes.

5. The electronic billboard of claim 4, wherein each sliding rod comprises a head and a shaft mounted to the rear wall of the display, the shaft is received in the latching hole, and the head abuts against the bracket.

6. The electronic billboard of claim 5, wherein the latching hole comprises a inserting portion and a mounting portion connected to the inserting portion, the sliding rod is configured to slide into the mounting portion from the inserting portion.

7. The electronic billboard of claim 6, wherein a diameter of the inserting portion is greater than that of the head, a diameter of the mounting portion is greater than that of the shaft but smaller than that of the inserting portion.

8. The electronic billboard of claim 6, wherein the latching hole is gourd-shaped.

9. The electronic billboard of claim 4, wherein the sliding rods are located at four corners of a square area.

10. The electronic billboard of claim 2, further comprising a mounting apparatus, wherein the mounting apparatus is configured to secure the host computing device in the receiving portion of the display.

11. The electronic billboard of claim 10, wherein the mounting apparatus comprises two sidewalls and a mounting plate mounted to the display, the sidewalls comprise hooks, the mounting plate defines latching slots, the sidewalls are coupled to the host computing device, the hooks are engaged in the latching slots.

12. The electronic billboard of claim 1, wherein the touch device comprises a transparent touch sensing layer covering a screen of the display.

13. The electronic billboard of claim 1, wherein the base comprises a mounting post, the bracket defines a mounting hole, the mounting post is engaged in the mounting hole.

14. The electronic billboard, comprising:

a display defining a slot and a receiving portion, the display comprises a screen;

a host computing device electrically coupled to the display to change contents on the display; and a touch device;

wherein the host computing device and the touch device are removable mounted to the display, the touch device covers the screen, the host computing device is received in the receiving portion, the touch device comprises a transparent touch sensing layer and a frame surrounded the touch sensing layer, the frame is secured in the slot.

15. The electronic billboard of claim 14, wherein the display further comprise a front wall and a rear wall, the slot is located between the front wall and the screen, the receiving portion is a slot defined in the rear wall.

16. The electronic billboard of claim 14, further comprising a mounting apparatus, wherein the host computing device is mounted to the mounting apparatus, the mounting apparatus is received in the receiving portion, the mounting apparatus comprises a mounting plate mounted to the display and two sidewalls located at two opposite sides of the host computing device, the mounting plate defines latching slots, the sidewalls comprise hooks engaged in the latching slots.

17. The electronic billboard of claim 14, comprising a bracket, wherein the display is removable mounted to the bracket in a vertical direction and a horizontal direction.

* * * * *